US005213267A

United States Patent [19]

Heimann et al.

[11] Patent Number: 5,213,267

[45] Date of Patent: May 25, 1993

[54] ADJUSTABLE HAND SHOWER

[75] Inventors: Bruno Heimann, Fröndenberg-Ardey; Bernd Bischoff, Iserlohn, both of Fed. Rep. of Germany

[73] Assignee: Friedrich Grohe Aktiengesellschaft, Hemer, Fed. Rep. of Germany

[21] Appl. No.: 883,839

[22] Filed: May 15, 1992

[30] Foreign Application Priority Data

May 24, 1991 [DE] Fed. Rep. of Germany ..... 4116929

[51] Int. Cl.[5] ..... B05B 1/18

[52] U.S. Cl. ..... 239/446; 239/553.3; 239/562

[58] Field of Search ..... 239/436, 443, 444, 446–449, 239/394, 553–553.5, 562, 558, 559

[56] References Cited

U.S. PATENT DOCUMENTS 4,187,986 2/1980 Petrovic .
5,090,624 2/1992 Rogers ..... 239/447

FOREIGN PATENT DOCUMENTS 2155075 5/1973 Fed. Rep. of Germany .
7920406 10/1979 Fed. Rep. of Germany .
2206683 6/1974 France .

*Primary Examiner*—Andres Kashnikow
*Assistant Examiner*—Karen B. Merritt
*Attorney, Agent, or Firm*—Herbert Dubno; Andrew Wilford

[57] ABSTRACT

A shower has a housing defining an axis, a conduit in the housing normally supplied with water under pressure and having an axially forwardly open outlet end, and a shower head having an axially rearwardly directed face axially confronting the outlet end and rotatable on the housing about the axis. The shower head is provided with at least two sets of axially forwardly directed spray nozzles and is formed with respective axially rearwardly open passages connected to the sets of nozzles. A seal disk extending across the axis between the outlet end and the rear face of the shower head is formed with an axially throughgoing hole and is fixed in the housing against rotation about the axis while being limitedly axially movable in the housing. An elastically compressible seal ring engaged axially between the outlet end of the conduit and the seal disk around the seal-disk hole presses the seal disk axially forward against the rear face of the shower head.

10 Claims, 4 Drawing Sheets

ADJUSTABLE HAND SHOWER

FIELD OF THE INVENTION

The present invention relates to an adjustable shower head. More particularly this invention concerns such a shower head used in a hand shower.

BACKGROUND OF THE INVENTION

A shower head usable in a hand shower, that is a shower head that is attached via a flexible hose to the water supply so it can be held and aimed by hand, is described in German utility model 7,920,406 filed Jul. 17, 1979 and assigned to Heinrich Ruschenbaum Metallschlauchfabrik. It has a head which can be turned about a housing axis between a pair of positions. In one position water exits from one set of nozzles on the head and in the other position it exits from another different set of nozzles. Each set of nozzles is differently constituted to achieve a different type of spray.

Such a device is relatively hard to move from one position to another by hand. In particular when manufacturing tolerances are too tight, the device can be very hard to adjust and is therefore subject to considerable wear. When the tolerances are too loose the device can leak.

OBJECTS OF THE INVENTION

It is therefore an object of the present invention to provide an improved shower.

Another object is the provision of such an improved shower which overcomes the above-given disadvantages, that is which can readily be moved from one position to another even when manufacturing tolerances are off, but that will not leak under any circumstances.

SUMMARY OF THE INVENTION

A shower has according to the invention a housing defining an axis, a conduit in the housing normally supplied with water under pressure and having an axially forwardly open outlet end, and a shower head having an axially rearwardly directed face axially confronting the outlet end and rotatable on the housing about the axis. The shower head is provided with at least two sets of axially forwardly directed spray nozzles and is formed with respective axially rearwardly open passages connected to the sets of nozzles. A seal disk extending across the axis between the outlet end and the rear face of the shower head is formed with an axially throughgoing hole and is fixed in the housing against rotation about the axis while being limitedly axially movable in the housing. An elastically compressible seal ring engaged axially between the outlet end of the conduit and the seal disk around the seal-disk hole presses the seal disk axially forward against the rear face of the shower head.

Thus with this system even if manufacturing tolerance are a little sloppy, the device will be easy to adjust but will not leak. The axially compressible seal ring provides enough pressure to prevent leakage over a wide range of axial positions without permitting any leakage.

According to the invention the housing includes a core element formed with a stem on which the disk is rotationally fixed, a rim axially engaging the ring, and an axially throughgoing hole having a rear end communicating with the seal-disk hole and a front end selectively alignable depending on angular position of the head with the passages.

According to the invention the rim is hermetically bonded to the outlet end of the conduit and the disk has an axially rearwardly directed peripheral shoulder axially engaging the ring. The shower head includes a diverter element formed with the passages and having a rear face at which same open and the disk is made of a synthetic resin with a low coefficient of friction. The diverter element is rotatable about the axis on the stem. The rear face is formed around at least one of the passages with an annular and axially rearwardly open groove and the shower head has according to the invention an O-ring seated in the groove and axially rearwardly engaging the disk.

In accordance with the invention the core element is formed with ribs extending to the rim and axially engaging the ring. The disk is formed with two such holes diametrally spaced from each other relative to the axis and the shower head is formed for each set of nozzles with two such passages diametrally offset from each other. This causes the pressure to be equal across the disk to keep it from canting in the housing.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
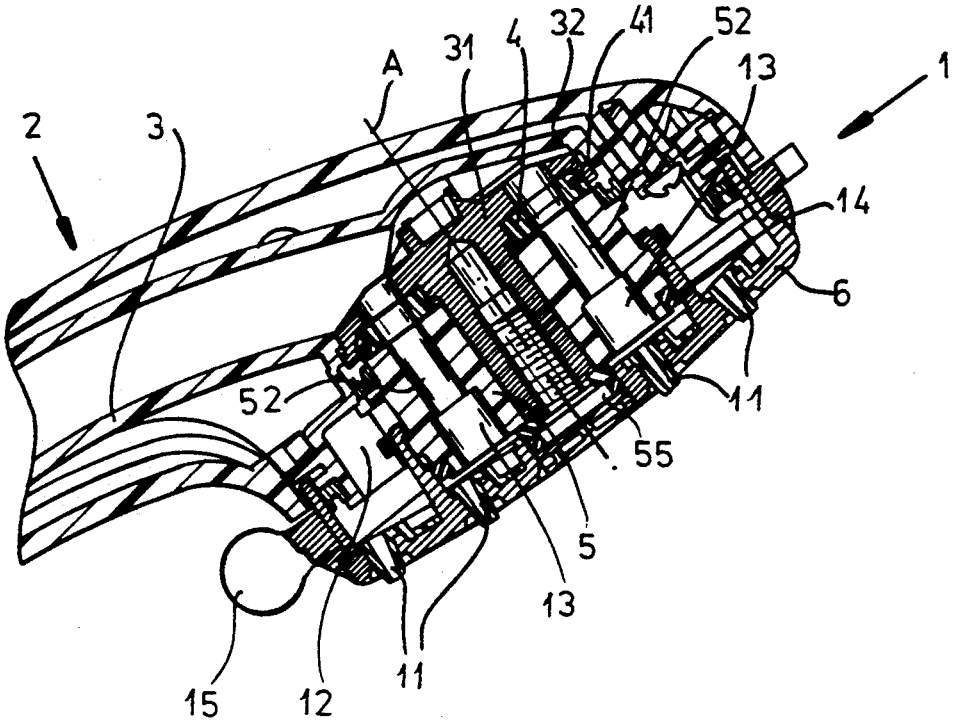
FIG. 1 is a longitudinal section through the spray end of a hand shower according to the invention in the full-spray position.
Figure 2:
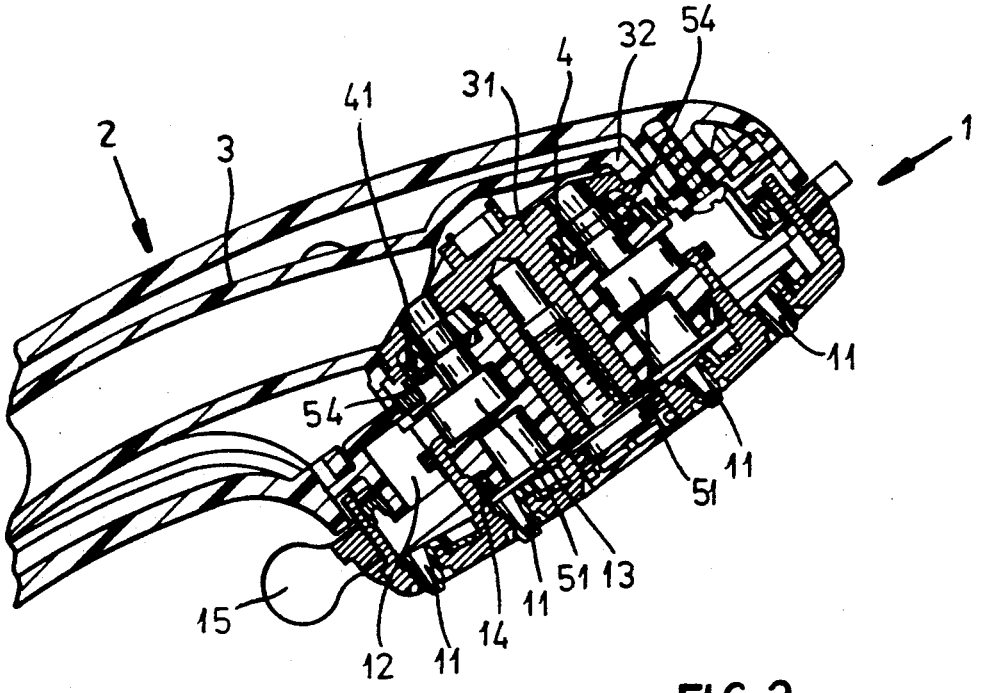
FIG. 2 is a view like FIG. 1 in the edge-spray position.
Figure 3:
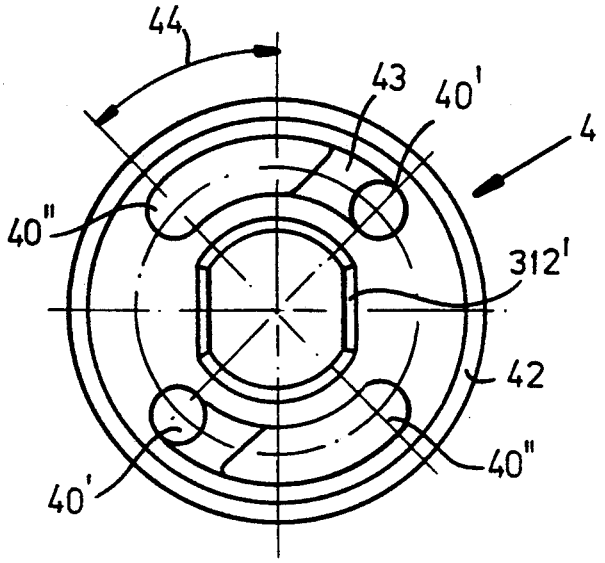
FIG. 3 is a top view of the seal disk according to the invention.
Figure 4:
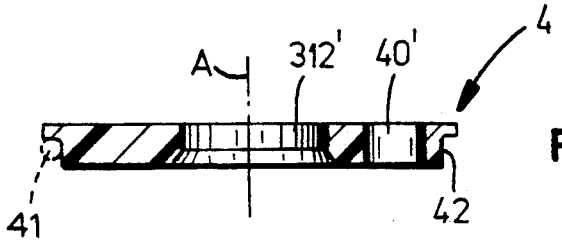
FIG. 4 is a section taken along line IV—IV of FIG. 5.
Figure 6:
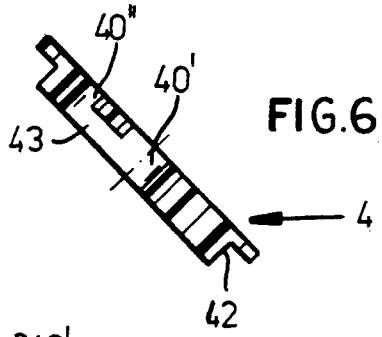
FIG. 6 is a section taken along line VI—VI of FIG. 5.
Figure 5:
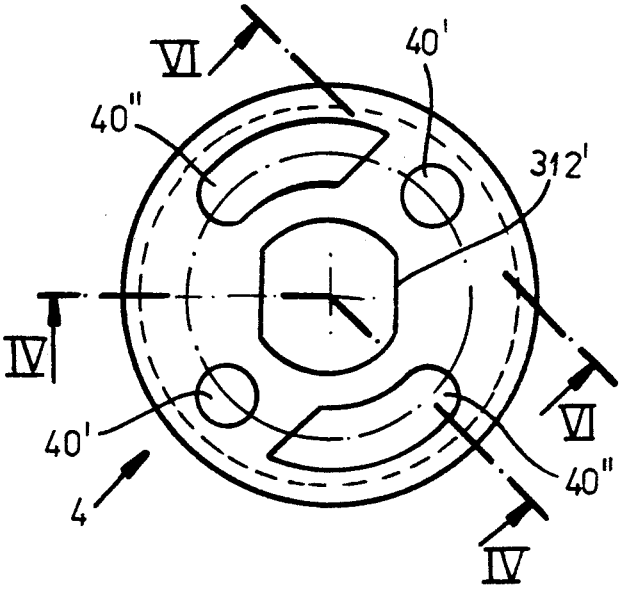
FIG. 5 is a bottom view of the seal disk.

As seen in FIGS. 1 and 2 a shower head 1 according to this invention is held in the outer end of a handle/-housing 2 of standard hand-shower construction. A water-feed tube 3 in the housing 2 is supplied with water under pressure and has an outer end forming a seat 32 in which the shower head 1 is fitted. The front face of the shower head is formed by a disk 6 in which spray nozzles 11 are set in two annular and concentric arrays.

Figure 7:
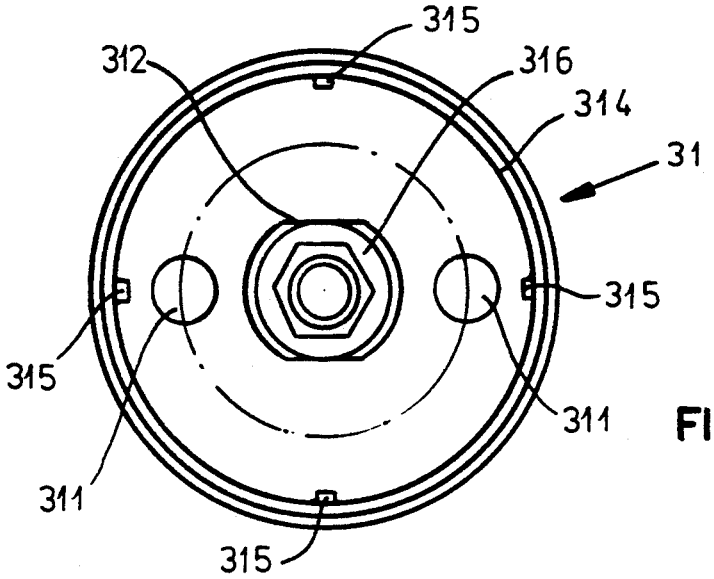
FIG. 7 is a top view of the core element of the shower head.
Figure 8:
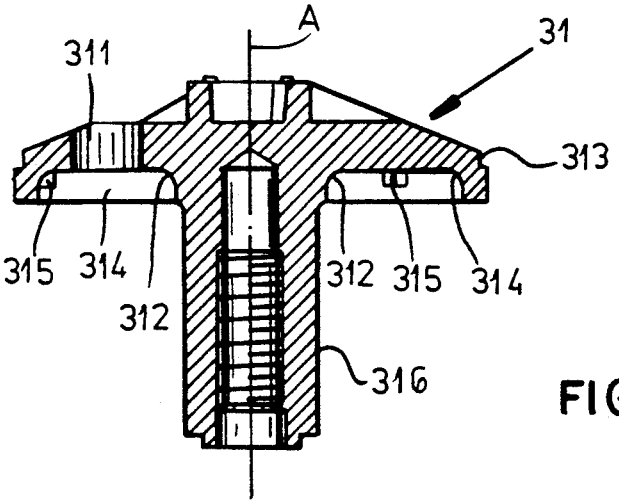
FIG. 8 is a section taken along line VIII—VIII of FIG. 9.
Figure 9:
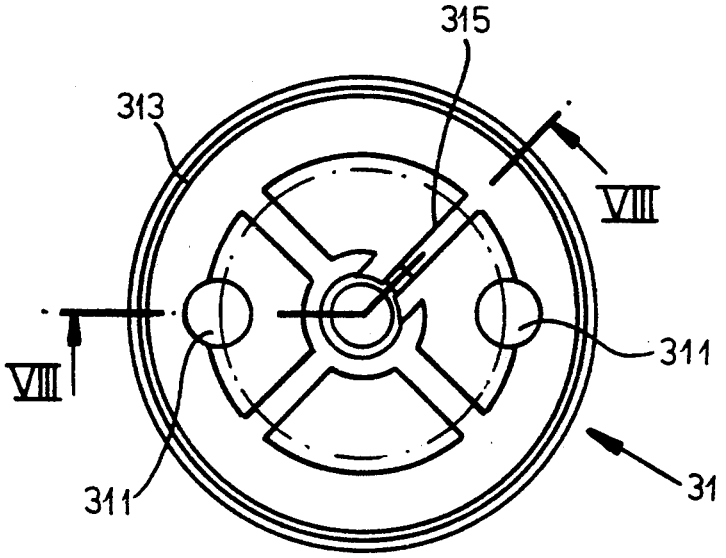
FIG. 9 is a bottom view of the core element.

The rear face of the shower head 1 is formed by a core element 31 centered on an axis A and shown in detail in FIGS. 7 through 9. It is formed with two diametrically opposite axially throughgoing holes 311 and has an outer rim 313 that is fixed, for instance by fusing, in the seat 32 so that all the water in the tube 3 must pass through the holes 311. Centrally the core element 31 is formed with a stem 316 surrounded by a polygonal or noncircular-section recess 312 and has ribs 315 that extend radially inward from its rim or shoulder 314 that is directed axially forward from its outer periphery.

Received within the core element 31 is a seal disk 4 shown in detail in FIGS. 3 through 6 and having a central hole 312' complementary to the recess 312 around the base of the stem 316. It is formed with four angularly equispaced and axially throughgoing holes 40' and 40''. The holes 40' are of circular section and the holes 40'' are arcuate and extend through an angle 44 of 45° relative to the axis A. This disk 4 is also formed with angularly extending passages or grooves 43 that connect each hole 40' with the adjacent hole 40''. It has an outer rim that bears via an axially compressible circular seal ring 41 (shown in dot-dash lines in FIG. 4) on the outer periphery or rim 314 of the core element 31. Thus the seal disk 4 can move limitedly axially on the stem 316 of the element 31 while still maintaining a tight seal therewith but is nonrotatable on the stem 316.

Figure 10:
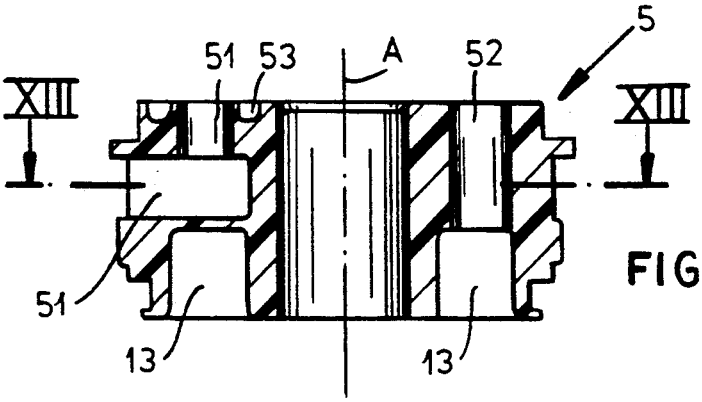
FIG. 10 is an axial section taken along line X—X of FIG. 12 through the diverter of the shower head.
Figure 11:
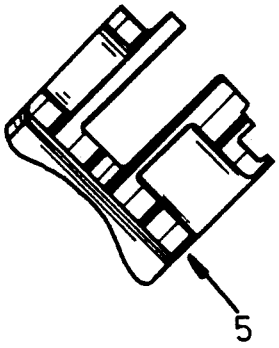
FIG. 11 is a section taken along line XI—XI of FIG. 12.
Figure 12:
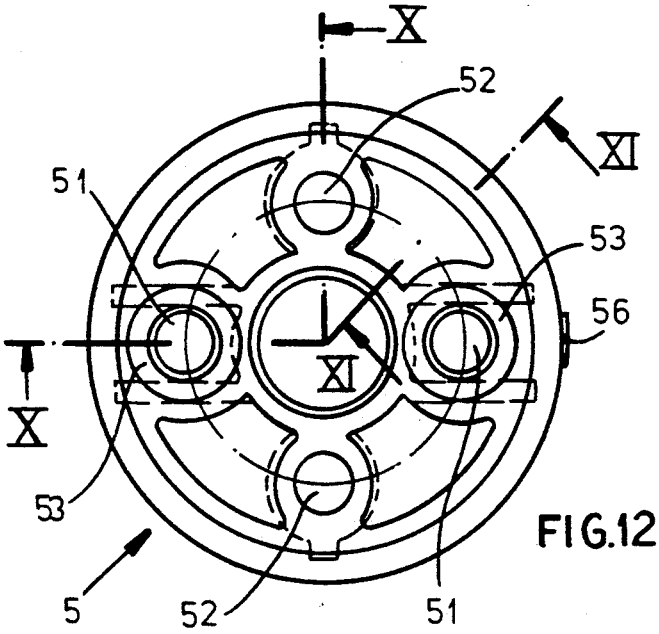
FIG. 12 is a top view of the diverter.
Figure 13:
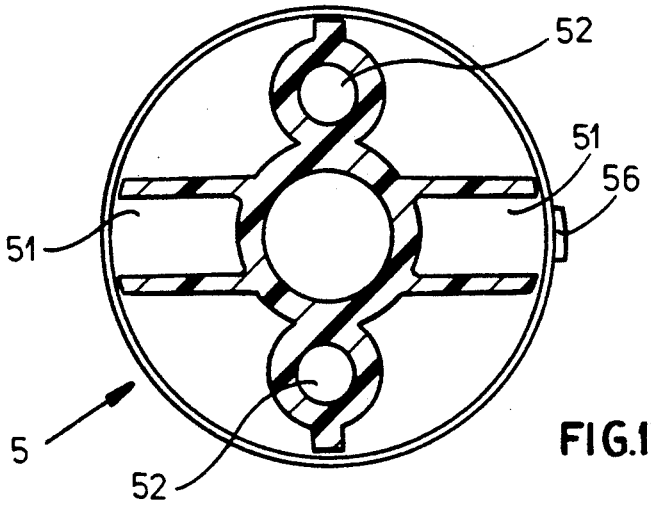
FIG. 13 is a section taken along line XIII—XIII of FIG. 10.

A flow guide/diverter 5 shown in detail in FIGS. 10 through 13 is rotatable on the stem 316, held axially in place thereon with the spray disk 6 by a screw 55. This diverter 5 is formed with two diametrically opposite and axially throughgoing holes or passages 52 and with two further halls or passages 51 opening axially backward and radially outward as best seen in FIG. 10. The passages 51 open into an annular chamber 12 formed behind the outer ring of nozzles 11 in the disk 6 and the holes 52 into an inner annular chamber 13 behind the inner annulus of nozzles 11. The rear face of the diverter 5 is formed around each hole 51 with an annular backwardly open groove 53 in which is set a respective O-ring 54 that rides continuously on the front face of the disk 4. Another O-ring 14 set in a forwardly and outwardly open groove in the front end of the element 5 tightly engages a rim of the plate 6 to form a tight seal therewith. A radially outwardly projecting arm 15 on the diverter 5 allows it and the disk 6 to be rotated about the axis A on the core element 31 while a bump 56 (FIG. 12) on the diverter 5 fits in an unillustrated angularly limited and radially inwardly open notch of the housing 2 to limit angular movement of these parts 5 and 6 in the housing 2 to 45°.

The device described above works as follows:

Pressurized water passes through the tube 3 and the holes 311 to the seal disk 4. This disk 4 is pressed by the elastic ring 41 axially via the ribs 315 against the end face of the diverter disk 5 with a modest pressure sufficient to maintain a tight seal. In addition the water pressure is effective on the end face of the seal disk 4 so that there is an additional sealing pressure created by the water pressure itself. Radial leakage of the water in the region of the seal disk 4 is hindered by the circumferential shoulder 314 and the shoulder 42 together with the ring 41. Thus manufacturing tolerances of the parts between the element 31 and the diverter 5 can be compensated out by the ring 41 effective as an axial spring without negatively affecting the ease of use of the positioning arm 15.

FIG. 2 shows the position of the disk 5 with the inner chamber 13 and also the outer chamber 12 pressurized with water so that water exits from all of the nozzles 11. In this position the holes 51 and 52 are aligned with the holes 40' and 40'' of the seal disk 4.

Turning the diverter 5 through 45° to the FIG. 7 position by means of the arm 15 positions the holes 51 with O-rings 54 in a region of the seal disk 4 in which there are no openings so that in this case holes 51 are blocked by the pressure of the ring 41 plus that of the existing water pressure. Water only exits from the head 1 through the center ring of nozzles 11 opening into the chamber 13.

The pairwise arrangement of the various holes prevents the disk 4 from getting canted in the device. In addition the provision of the transfer passage 43 ensures that the two O-rings 54 lie in every angular position of the diverter 5 on the disk 4.

We claim:

1. A shower comprising:

a housing defining an axis;

a conduit in the housing normally supplied with water under pressure and having an axially forwardly open outlet end;

a shower head having an axially rearwardly directed face axially confronting the outlet end and rotatable on the housing about the axis, the shower head being provided with at least two sets of axially forwardly directed spray nozzles and being formed with respective axially rearwardly open passages connected to the sets of nozzles;

a seal disk extending across the axis between the outlet end and the rear face of the shower head, formed with an axially throughgoing hole, fixed in the housing against rotation about the axis, and limitedly axially movable in the housing; and an elastically compressible seal ring engaged axially between the outlet end of the conduit and the seal disk around the seal-disk hole and pressing the seal disk axially forward against the rear face of the shower head.

2. The shower defined in claim 1 wherein the housing includes a core element formed with a stem on which the disk is rotationally fixed, a rim axially engaging the ring, and an axially throughgoing hole having an end communicating with the seal-disk hole and an opposite end selectively alignable depending on angular position of the head with the passages.

3. The shower defined in claim 2 wherein the rim is hermetically bonded to the outlet end of the conduit.

4. The shower defined in claim 2 wherein the disk has an axially rearwardly directed peripheral shoulder axially engaging the ring.

5. The shower defined in claim 2 wherein the shower head includes a diverter element formed with the passages and having a rear face at which the passages open.

6. The shower defined in claim 5 wherein the disk is made of a synthetic resin with a low coefficient of friction.

7. The shower defined in claim 5 wherein the diverter element is rotatable about the axis on the stem.

8. The shower defined in claim 5 wherein the rear face is formed around at least one of the passages with an annular and axially rearwardly open groove, the shower head comprising an O-ring seated in the groove and axially rearwardly engaging the disk.

9. The shower defined in claim 2 wherein the core element is formed with ribs extending to the rim and axially engaging the ring.

10. The shower defined in claim 2 wherein the disk is formed with two such holes diametrally spaced from each other relative to the axis and the shower head is formed for each set of nozzles with two such passages diametrally offset from each other.

* * * * *